US011322864B2

(12) United States Patent
Gentsch et al.

(10) Patent No.: US 11,322,864 B2
(45) Date of Patent: May 3, 2022

(54) FIXATION SYSTEM THAT SERVES TO GROUND AN INSULATED HOUSING

(71) Applicant: ABB Schweiz AG, Baden (CH)

(72) Inventors: Dietmar Gentsch, Ratingen (DE); Christian Reuber, Willich (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/899,599

(22) Filed: Jun. 12, 2020

(65) Prior Publication Data

US 2020/0313317 A1 Oct. 1, 2020

Related U.S. Application Data

(63) Continuation of application No. PCT/EP2018/084999, filed on Dec. 14, 2018.

(30) Foreign Application Priority Data

Dec. 15, 2017 (EP) ..... 17207827

(51) Int. Cl.

| | |
|---|---|
| ***H01R 4/64*** | (2006.01) |
| ***H01H 9/48*** | (2006.01) |
| ***H01R 4/56*** | (2006.01) |
| *H01R 4/34* | (2006.01) |

(52) U.S. Cl.

CPC ..... *H01R 4/64* (2013.01); *H01H 9/48* (2013.01); *H01R 4/56* (2013.01); *H01R 4/34* (2013.01)

(58) Field of Classification Search

CPC ..... H01R 4/64; H01R 4/56; H01H 9/48

See application file for complete search history.

(56) References Cited

U.S. PATENT DOCUMENTS

| | | | | |
|---|---|---|---|---|
| 5,458,512 A * | 10/1995 | Takano | ..... | H01R 4/64 439/801 |
| 8,231,080 B2 * | 7/2012 | Robb | ..... | B64C 1/068 244/119 |
| 8,497,446 B1 | 7/2013 | Glaser | | |

FOREIGN PATENT DOCUMENTS

| | | |
|---|---|---|
| JP | H 08130387 A | 5/1996 |
| JP | H 11331016 A | 11/1999 |
| WO | WO 2014102699 A1 | 7/2014 |

* cited by examiner

*Primary Examiner* — Vanessa Girardi

(74) *Attorney, Agent, or Firm* — Leydig, Voit & Mayer, Ltd.

(57) ABSTRACT

A fixation system in use for medium or high voltage switching poles, insulators, circuit breakers, or general devices includes: an insulating housing provided with holes, in which screws are screwed into, in order to fix the device on a support, or a further housing. Inner surfaces of the holes are covered with a conductive layer or layers covering the inner surfaces at least partly. The conductive layers extend toward outside the holes. The conductive layers are conductively connected or connectable to ground potential.

13 Claims, 3 Drawing Sheets

FIXATION SYSTEM THAT SERVES TO GROUND AN INSULATED HOUSING

CROSS-REFERENCE TO PRIOR APPLICATION

This application is a continuation of International Patent Application No. PCT/EP2018/084999, filed on Dec. 14, 2018, which claims priority to European Patent Application No. EP 17207827.1, filed on Dec. 15, 2017. The entire disclosure of both applications is hereby incorporated by reference herein.

FIELD

This invention refers to a fixation system for medium and high-voltage switching poles, insulators, circuit breakers (CB) and general devices, with an insulating housing that is provided with holes, in which screws are screwed into, in order to fix the device on a support, or a further housing.

BACKGROUND

Insulating parts in CB or switchgear need to be fixed to other parts. Screws are often used for this purpose. To provide a reliable thread for said screws in insulating parts, dowels are often used. The dowels are permanently fixed to the insulating parts, e.g. by gluing or by integral casting.

It is also possible to save the dowels and to use screws that form or cut the thread directly in the insulation material.

Insulating parts in Medium Voltage or High Voltage CB or switchgear are exposed to electrical fields. Depending on the geometries of live parts, grounded parts and insulating parts, the electrical field is usually not homogeneous. In contrary, areas of high electrical field density can occur especially in the border areas of insulation media and conductors, e.g. where solid insulation parts end and air begins at the surface of a conductive part, also referred to as triple points. Said high electrical field densities can result in partial discharges, limiting the lifetime of the equipment.

Dowels can have an outer surface with relative large radii and without sharp edges. When made of conductive material (e.g. brass), the electrical field density at the transition from the dowel to the insulating part can be relatively low. As no air is involved at this transition, the field strength of the material of the insulating part (e.g. duroplast, BMC or thermoplastic material) can be exploited for a compact design of the switchgear.

If the dowels shall be saved, the screws are directly inserted into the insulating material. The screws, that are usually made of electrically conductive material like steel, have relatively sharp edges at their thread. These edges will increase the density of the electrical filed compared to the smooth surface of the dowels. Further, for the insertion of the screws, the insulating part will provide a hole that will not fully be filled by the inserted screw. Consequently, gas will be present in the region of the high electrical field density. Partial discharges may occur to an extend that is not acceptable for a reliable operation of the CB or switchgear.

SUMMARY

In an embodiment, the present invention provides a fixation system in use for medium or high voltage switching poles, insulators, circuit breakers, or general devices, comprising: an insulating housing provided with holes, in which screws are screwed into, in order to fix the device on a support, or a further housing, wherein inner surfaces of the holes are covered with a conductive layer or layers covering the inner surfaces at least partly, wherein the conductive layers extend toward outside the holes, and wherein the conductive layers are conductively connected or connectable to ground potential.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

In an embodiment, the present invention provides a mechanically optimized fixation of the pole part and/or the circuit breaker, which is optimized also in its performance of dielectric withstand.

In order to fulfill that, the present invention proposes to make the inner surface of the hole conductive, by deposing a conductive layer for example. The inserted screw will electrically connect to this conductive layer and then to earth potential, or said conductive layer extends to another part, that is directly connected to earth potential, so that the effective surface for the electrical field will be the inner surface of the hole, and no longer the surface of the screw. Further, there will no longer be an electrical field in gas. Triple points are then avoided.

For making the inner surface of the hole conductive, it is proposed to apply a conductive varnish to said surface. This conductive varnish can e.g. use silver, coper or graphite particles as conductive component.

Optionally, it is proposed to activate the surface prior to applying the varnish to improve the adhesive strength and the long-term reliability of the varnishing. Said activation can be obtained e.g. with a plasma or flame treatment or with a chemical treatment.

Figure 1:
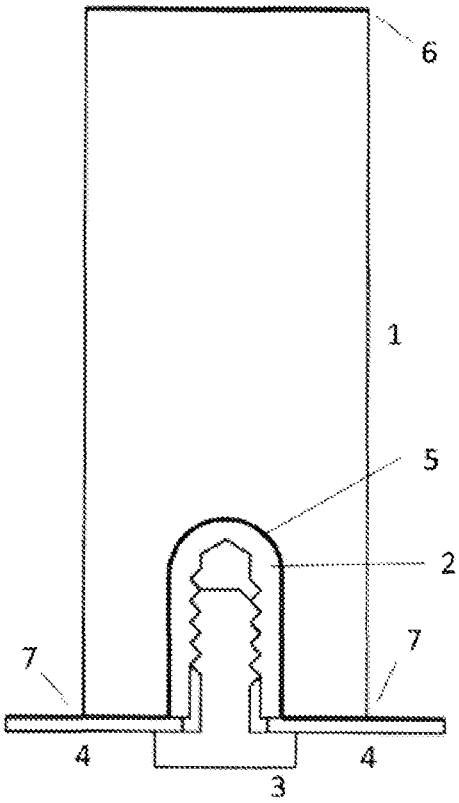
Fig. 1 PRIOR ART
FIG. 1: state of the art, using a dowel

FIG. 1 shows the commonly used dowel 2 that is permanently fixed into the insulator 1. A screw 3 fixes the insulator to the conductive ground plate 4 that represents earth potential. The electrical potential of plate 4 is shown with the thick line 5. The other electrical potential shall be represented by the thick line 6. The exposition of line 5 towards line 6 is showing a relatively large radius at the top side of the dowel 2. There are triple points 7 at line 5, at the lateral ends of insulator 1, but as these points are relatively far away from the line 6 and as this situation is the same for all figures shown here, these points 7 are not subject of the present invention.

Figure 2:
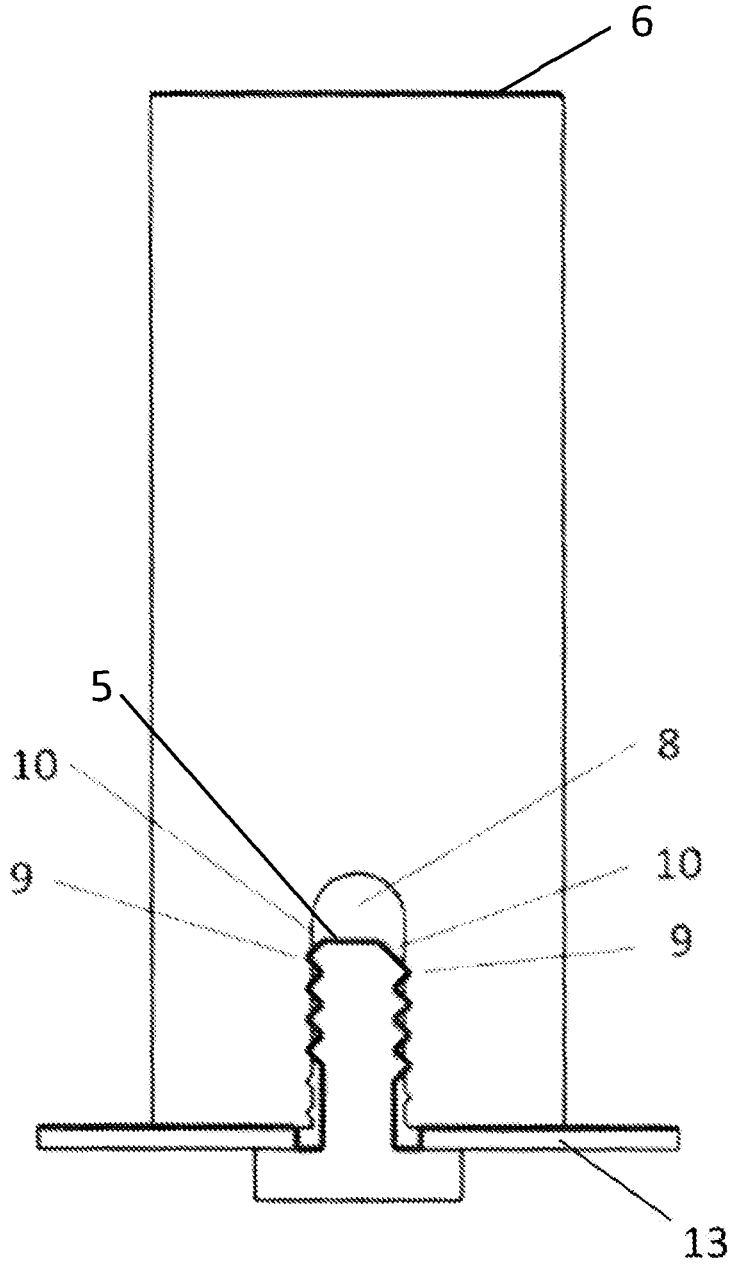
Fig. 2 PRIOR ART
FIG. 2: state of the art, not using a dowel

FIG. 2 shows the state of the art when a screw 3 is directly inserted or screwed into a hole 8 of the insulating material 1, fixing the insulating material on a support or further housing 13. Line 5 now shows the outline of the screw 3 pointing towards the other electrical potential of line 6. Beside the sharp edges 9 of the end of the thread of the screw, there are additional triple points 10 exposed to the other electrical potential. Here, partial discharges are likely to occur first when the overall dimensions are small compared to the applied voltage.

Figure 3:
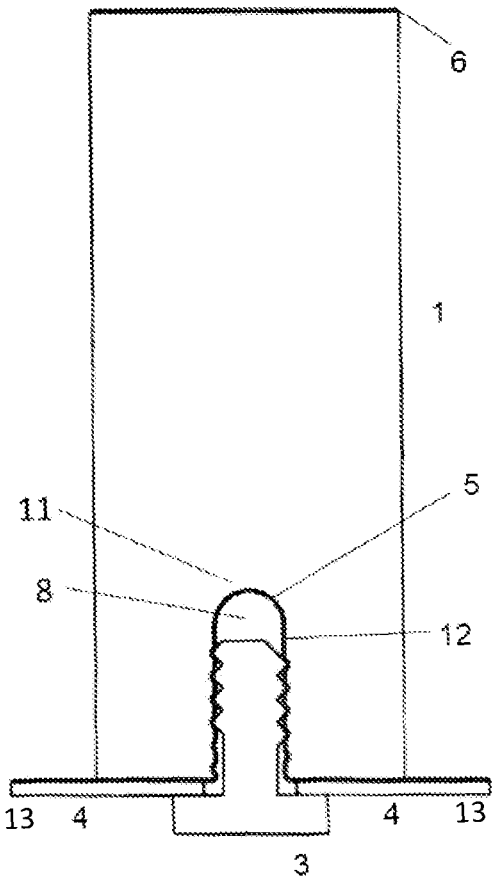
FIG. 3: first embodiment of the invention

FIG. 3 shows the solution that is proposed in this invention. Due to the added conductivity of the hole 8, the line 5 shows now the relatively large radius of the hole 8. Any triple points in the region around the screw 3 are avoided. There are still sharp edges of the screw, but these are not critical from the electrical point of view, as they are shielded by the ground plate 4 and by the more exposed area 11 of the hole 8.

The conductive layer or foil 12 at the inside of the hole 8 needs to be electrically connected to the potential of the plate 4, which can be e.g. the ground potential or any other potential. This connection can be realised by the conductive screw and/or by pressing the plate 4 to a conductive region at the collar of the hole 8. In the latter case, the proposed principle also works with electrically non-conductive screws.

Beside insulators, the proposed method can be applied to all kinds of casted parts in MV CBs or switchgears, like e.g. bushings or poles.

The conductive material can be deposed metals layers, or conductive varnishes, or conductive foils.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE LIST

1 Insulator
2 Dowel
3 Screw
4 Plate
5 Thick line
6 Line
7 Triple points
8 Hole
9 Sharp edges
10 Triple points
11 Exposed area
12 Conductive layer
13 support or further housing

What is claimed is:

1. An insulator housing of a medium or high voltage switching pole, circuit breaker, or general device, the insulator housing comprising:

one or more holes, each hole comprising a single opening, wherein each hole of the one or more holes is configured to receive a screw to fix the insulator housing to a support or a further housing, wherein an inner surface of each hole of the one or more holes comprises a conductive layer or foil extending from an end of each hole opposite the single opening to at least an intersection of the hole surface and a thread of the received screw and is configured so as to be conductive, and wherein the conductive layer or foil is configured to connect to earth potential.

2. The insulator housing of claim 1, wherein the conductive layer or foil is configured to connect to earth potential via another part that is directly connected to earth potential.

3. The insulator housing of any of claim 1, wherein the inner surface of each hole of the one or more holes comprises a conductive varnish.

4. The insulator housing of any of claim 3, wherein the conductive varnish comprises silver, copper, or graphite particles.

5. A fixation system, comprising:

an insulator housing of a medium or high voltage switching pole, circuit breaker, or general device;

one or more screws; and a support or a further housing, wherein the insulator housing comprises one or more holes, each hole comprising a single opening, wherein an inner surface of each hole one of the one or more holes comprises a conductive layer or foil extending from an end of each hole opposite the single opening to at least an intersection of the hole surface and a thread of the received screw and is configured so as to be conductive, wherein the conductive layer or foil is configured to connect to earth potential, and wherein the one or more screws connect the insulator housing to the support or further housing via the one or more holes.

6. The fixation system of claim 5, wherein the conductive layer or foil is configured to connect to earth potential via another part that is directly connected to earth potential, or wherein the conductive layer or foil is configured to connect to earth potential via the one or more screws.

7. The fixation system of claim 5, wherein the inner surface of each hole of the one or more holes comprises a conductive varnish.

8. The fixation system of claim 7, wherein the conductive varnish comprises silver, copper, or graphite particles.

9. A method of forming an insulator housing of a medium or high voltage switching pole, circuit breaker, or general device, the method comprising:

forming one or more holes in the insulator housing, each hole of the one or more holes comprising a single opening and being configured to receive a screw to fix the insulator housing to a support or a further housing;

covering an inner surface of each hole of the one or more holes with a conductive layer or foil so as to be conductive, the conductive layer or foil extending from an end of each hole opposite the single opening to at least an intersection of the hole surface and a thread of the received screw; and configuring the conductive layer or foil to connect to earth potential.

10. The method of claim 9, wherein:

covering comprises depositing a conductive layer on the inner surface of each hole of the one or more holes.

11. The method of claim 9, wherein:

covering comprises applying a conductive varnish to the inner surface of each hole of the one or more holes.

12. The method of claim 11, wherein the conductive varnish comprises silver, copper, or graphite particles.

13. The method of claim 11, further comprising:

activating the inner surface of each hole of the one or more holes prior to applying the conductive varnish, wherein the activating comprises treating with a plasma, flame, or chemical.

* * * * *